US008783825B2

(12) United States Patent
Tomida et al.

(10) Patent No.: US 8,783,825 B2
(45) Date of Patent: Jul. 22, 2014

(54) PRINTING APPARATUS

(71) Applicant: Canon Kabushiki Kaisha, Tokyo (JP)

(72) Inventors: Asako Tomida, Kawasaki (JP); Masaya Uetsuki, Yokohama (JP); Kazuo Suzuki, Yokohama (JP); Toshimitsu Danzuka, Tokyo (JP); Masataka Kato, Yokohama (JP); Tsuyoshi Ibe, Yokohama (JP); Hiroaki Komatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/830,206

(22) Filed: Mar. 14, 2013

(65) Prior Publication Data

US 2013/0257977 A1 Oct. 3, 2013

(30) Foreign Application Priority Data

Mar. 28, 2012 (JP) ..... 2012-073136
Jan. 25, 2013 (JP) ..... 2013-011886

(51) Int. Cl.
*B41J 2/165* (2006.01)

(52) U.S. Cl.
USPC ..... 347/33

(58) Field of Classification Search
CPC ..... B41J 2/165; B41J 2/16535
USPC ..... 347/33
See application file for complete search history.

(56) References Cited

U.S. PATENT DOCUMENTS

| | | | | |
|---|---|---|---|---|
| 4,928,120 | A * | 5/1990 | Spehrley et al. | 347/33 |
| 4,947,190 | A * | 8/1990 | Mizusawa et al. | 347/33 |
| 6,283,574 | B1 * | 9/2001 | Sugimoto et al. | 347/23 |
| 7,073,886 | B2 * | 7/2006 | Nakamura | 347/33 |
| 7,311,378 | B2 * | 12/2007 | Fujimori et al. | 347/33 |
| 8,262,195 | B2 * | 9/2012 | Maida et al. | 347/33 |
| 2013/0222476 | A1 * | 8/2013 | Inoue | 347/33 |

FOREIGN PATENT DOCUMENTS

JP 2003-300329 A 10/2003

* cited by examiner

*Primary Examiner* — Alessandro Amari
*Assistant Examiner* — Michael Konczal
(74) *Attorney, Agent, or Firm* — Canon USA, Inc., IP Division

(57) ABSTRACT

A printing apparatus includes a print head, a scanning unit, a sheet-form member, a winding device, and a determining unit. The print head includes an orifice face having an ejection orifice to eject a liquid. The scanning unit performs scanning while reciprocating the print head. The sheet-form member performs a wiping operation of the orifice face of the print head, wherein the wiping operation includes a first wiping operation and a second wiping operation. The winding device performs a winding operation of the sheet-form member. The determining unit determines a length of the sheet-form member that is to be wound by the winding device in accordance with a length of time between the first wiping operation performed by the sheet-form member and the second wiping operation performed by the sheet-form member that follows the first wiping operation.

10 Claims, 16 Drawing Sheets

FIG. 12

| | LENGTH OF USED WEB | |
|---|---|---|
| | A1 | |
| | FOUR PASSES | EIGHT PASSES |
| FIRST EMBODIMENT | 192 mm | 384 mm |
| NO WINDING CONTROL | 256 mm | 512 mm |

FIG. 15

| | LENGTH OF USED WEB | |
|---|---|---|
| | A1 | |
| | FOUR PASSES | EIGHT PASSES |
| SECOND EMBODIMENT | 153.6 mm | 307.2 mm |
| NO WINDING CONTROL | 256 mm | 512 mm |

PRINTING APPARATUS

BACKGROUND OF THE INVENTION

1. Field of the Invention

The present invention relates to a printing apparatus that performs printing by ejecting droplets from a print head.

2. Description of the Related Art

Inkjet printing apparatuses include a print head having ink ejection orifices (hereinafter also referred to as nozzles) configured to eject a recording ink. When inkjet printing apparatuses eject an ink, the ink may adhere to a portion around the ink ejection orifices and may prevent a subsequent portion of ink from being properly ejected. Examples of such inkjet printing apparatuses include one that uses a reactive ink or a combination of a reactant and an ink and one that solidifies an ink with ultraviolet rays, microwaves, or heat to improve the fastness properties of the ink. In these inkjet printing apparatuses, an ink is more likely to be prevented from being properly ejected, thereby making it difficult to solve the problem of defective ejection. In order to solve the above problems, various methods of cleaning the surface of the print head on which the ejection orifices are formed (hereinafter also referred to as an orifice face) have been developed for inkjet printing apparatuses.

In order to prevent an ink from adhering to the orifice face of the print head and causing defective ejection, typical inkjet printing apparatuses include a member called a wiper that wipes the orifice face. The wiper wipes (performs a wiping operation) an ink adhering to the orifice face at an appropriate timing. The timing at which the wiper performs the wiping operation is determined, for example, by using a count of the number of times the print head ejects an ink (dot counting) and a timer in combination. In another example, the timing at which the wiper performs a wiping operation is determined by using normal dot-counting and printing duty.

The ink wiping proficiency may deteriorate in the following cases: the case where the ink adhering to the orifice face increases its viscosity due to evaporation of an ink solvent; and the case where a wiping operation cannot be performed for a long time due to the print head being heated to a high temperature or due to a long time being taken to perform printing. To address the above cases, a wiping operation may be performed after a wiper liquid containing at least one of an ink, an undiluted solvent, and a solution of the solvent is caused to adhere to the wiper (Japanese Patent Laid-Open No. 2003-300329).

Recently, a type of inkjet printing apparatus in which an ink adhering to a print medium is heated so as to be fixed to the print medium has been developed. In the inkjet printing apparatus according to Japanese Patent Laid-Open No. 2003-300329, an ink that has adhered to the orifice face is wiped by a sheet-form member serving as a cleaning unit instead of a wiper. A portion of the sheet-form member is used to clean the orifice face and then a predetermined length of the sheet-form member is wound so that an unused portion of the sheet-form member comes into contact with the orifice face of the print head in subsequent cleaning.

However, if, as in the case of Japanese Patent Laid-Open No. 2003-300329, the inkjet printing apparatus is controlled such that a predetermined length of the sheet-form member is wound every time after use, a length longer than necessary may be wound, and thus the sheet-form member may be wasted.

SUMMARY OF THE INVENTION

According to an aspect of the present invention, a printing apparatus includes a print head having an orifice face, wherein the orifice face includes an ejection orifice configured to eject a liquid, a scanning unit configured to perform scanning while reciprocating the print head, a sheet-form member configured to perform a wiping operation of the orifice face of the print head, wherein the wiping operation includes a first wiping operation and a second wiping operation, a winding device configured to perform a winding operation of the sheet-form member, and a determining unit configured to determine a length of the sheet-form member that is to be wound by the winding device in accordance with a length of time between the first wiping operation performed by the sheet-form member and the second wiping operation performed by the sheet-form member that follows the first wiping operation.

The present invention provides a printing apparatus that can highly reliably restore a print head without wasting a sheet-form member. In other words, in the present invention, a printing apparatus includes: a print head having an orifice face, wherein the orifice face includes an ejection orifice configured to eject a liquid; a scanning unit configured to perform scanning while reciprocating the print head; a sheet-form member configured to perform a wiping operation of the orifice face of the print head, wherein the wiping operation includes a first wiping operation and a second wiping operation; a winding device configured to perform a winding operation of the sheet-form member; and a determining unit configured to determine a length of the sheet-form member that is to be wound by the winding device in accordance with a length of time between the first wiping operation performed by the sheet-form member and the second wiping operation performed by the sheet-form member that follows the first wiping operation.

By changing the length of a sheet-form member that is to be wound in accordance with the length of time between the first wiping operation and the second wiping operation, the printing apparatus can highly reliably restore a print head without wasting a sheet-form member.

Further features of the present invention will become apparent from the following description of exemplary embodiments with reference to the attached drawings.

BRIEF DESCRIPTION OF THE DRAWINGS

FIG. 12 is a table showing the length of use of sheet-form members according to the first embodiment and a comparative example.

FIG. 15 is a table showing the length of use of sheet-form members according to the second embodiment and a comparative example.

DESCRIPTION OF THE EMBODIMENTS

First Embodiment

Figure 1:
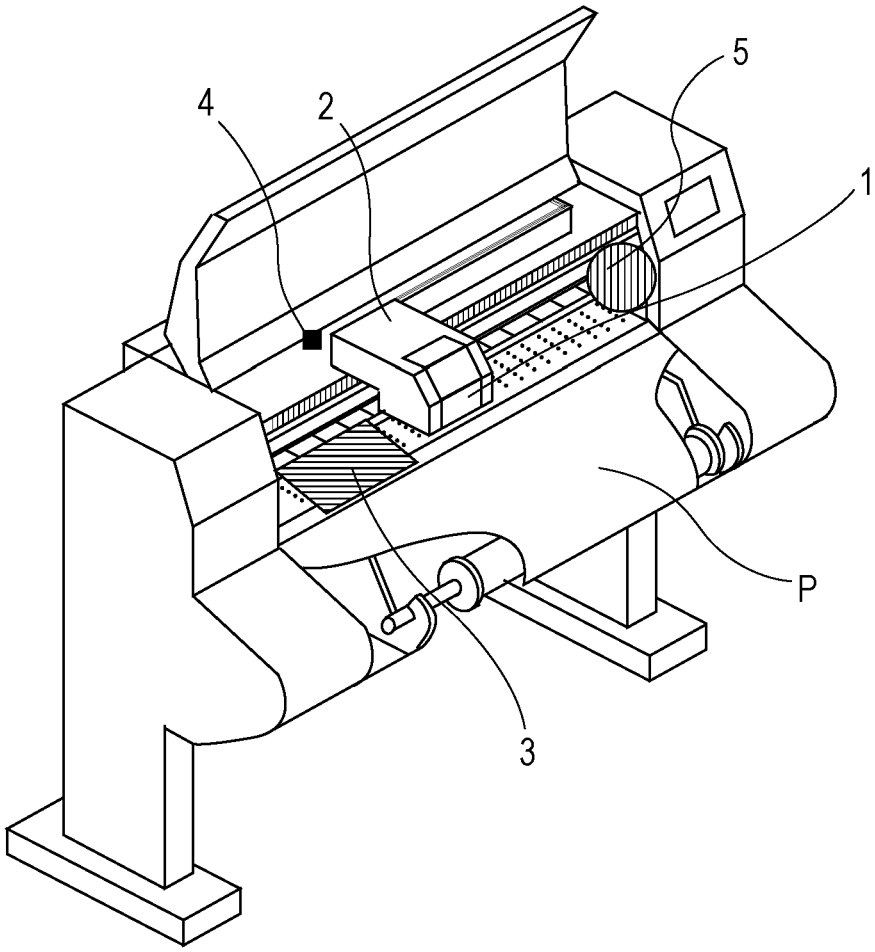
FIG. 1 is a schematic view of an inkjet printing apparatus.

Referring now to the drawings, an embodiment of the invention will be described below. Although a description is given on an example of an inkjet printing apparatus that performs printing by using a print head having an orifice face having ejection orifices configured to eject an ink, used as a liquid, the present invention is generally applicable to other types of printing apparatuses that eject a liquid other than an ink.

Brief Description of Inkjet Printing Apparatus

FIG. 1 is a schematic view of an inkjet printing apparatus. The printing apparatus includes a print head 1 and a carriage 2. The print head 1 is mounted on the carriage 2. During printing, the carriage 2 reciprocally moves (scans) in a main scan direction. While the carriage 2 is scanning, the print head 1 ejects an ink through ejection orifices of the print head 1 to form an image on a print medium P. The print medium P is conveyed in a sub-scan direction, which crosses the main scan direction, during time between a forward movement and a backward movement of the carriage 2 in the main scan direction and time between a backward movement and a forward movement of the carriage 2 in the main scan direction.

Figure 3:
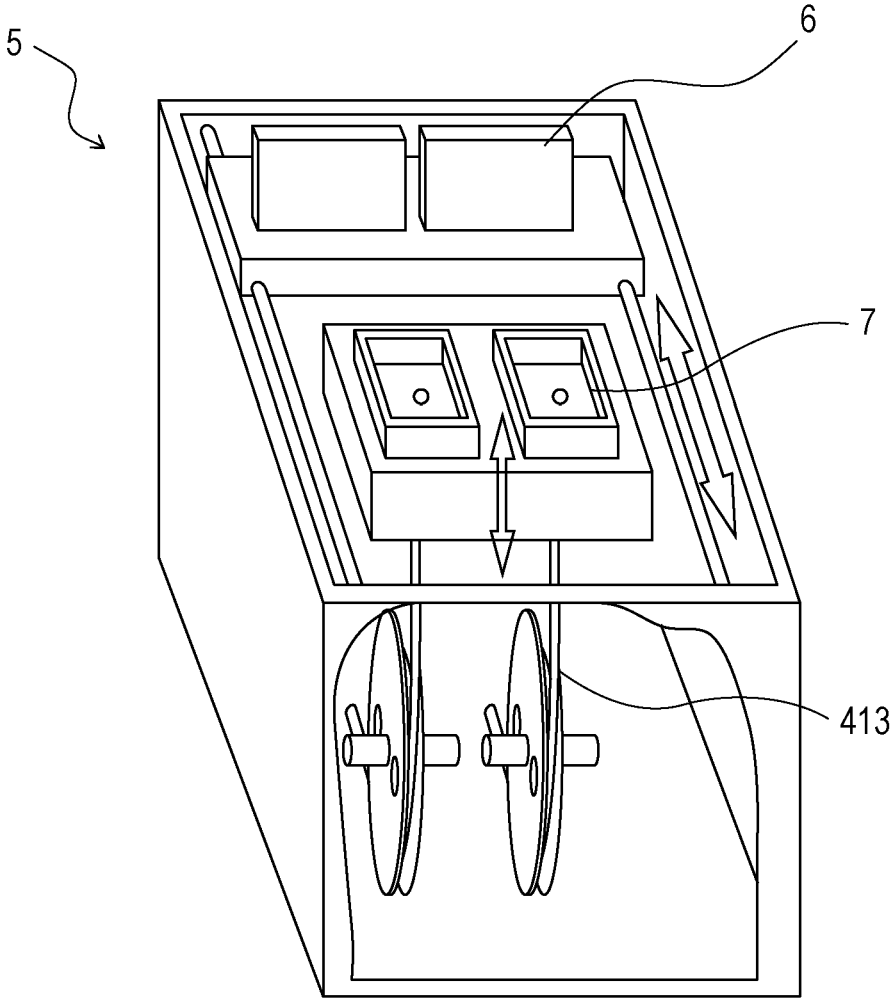
FIG. 3 is a schematic view of a restoring unit.

The printing apparatus includes a restoring unit 5 that restores the print head 1. As illustrated in FIG. 3, the restoring unit 5 includes caps 7 and wipers 6. The caps 7 protect nozzles of the print head 1 and the wipers 6 wipe the orifice face of the print head 1. Suction mechanisms 413 are connected to the caps 7. The suction mechanisms 413 can suck inks from the nozzles formed on the orifice face of the print head 1 covered by the caps 7.

Besides the restoring unit 5, the printing apparatus includes a cleaning web 3 to keep the orifice face of the print head 1 clean. Preferably, the cleaning web 3 is disposed in a print area in an end portion of a platen that holds a print medium P and at a position over which the print head 1 passes during a printing operation. In other words, the cleaning web 3 is preferably disposed near an edge of a movable region of the carriage 2 in the main scan direction. By being disposed in the above manner, the cleaning web 3 can clean the orifice face of the print head 1 while the carriage 2 makes one reciprocal movement during a printing operation. In addition, a sensor 4 that detects a pass of the carriage 2 may be disposed in a region over which the carriage 2 scans. A wiping operation may be triggered by a signal from the sensor 4 as a result of the sensor 4 detecting an action of the carriage 2.

Configuration of Recording Head

Figure 2:
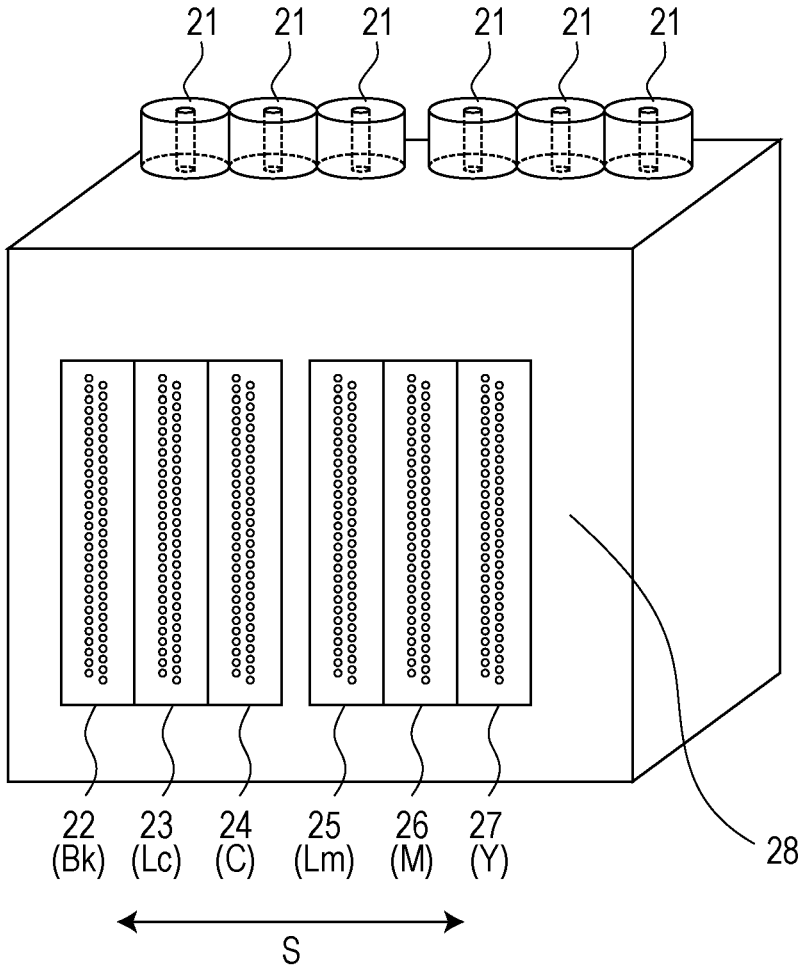
FIG. 2 is a schematic perspective view of a print head.

FIG. 2 is a schematic perspective view of the print head 1 viewed from a side from which an ink is ejected. In the print head 1, multiple ejecting portions 22 to 27, which can eject inks of different color tones (including the color and the density), are arranged side by side in the main scan direction S. These ejecting portions 22 to 27 can eject inks of, for example, black (Bk), light cyan (Lc), cyan (C), light magenta (Lm), magenta (M), and yellow (Y). Inks are fed to the ejecting portions 22 to 27 from ink inlets 21 via ink flow paths inside the print head 1. Inks are fed to the ink inlets 21 from ink tanks via tubes. The surface on which ejection orifices of the print head 1 are formed is an orifice face 28.

Example of Configuration of Control System

Figure 4:
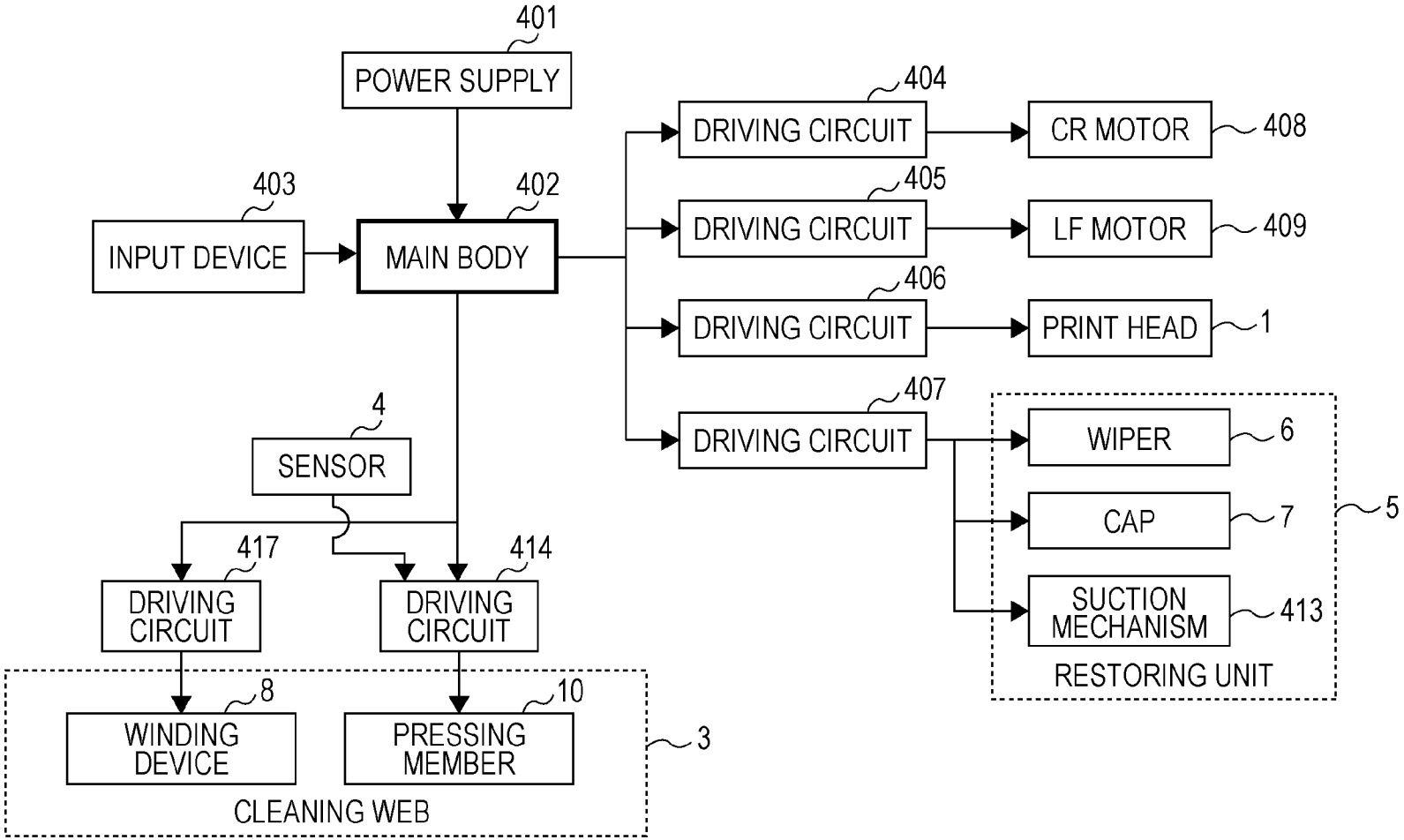
FIG. 4 is a block diagram of a control system for controlling the entirety of the apparatus.

FIG. 4 is a block diagram of a configuration of a control system of the inkjet printing apparatus. The reference numeral 401 is a power supply 401. A main body 402 includes a control unit that includes a CPU as a main calculator and a ROM or a RAM as a storage device. An input device 403 is a device such as a personal computer or an operating panel. The input device 403 transmits information such as image data, a recording mode (printing mode), or conditions on the main body (such as the height of the head or the suction force of the platen) to the main body 402. Operation conditions are set based on the transmitted image data or recording mode. The main body 402 operates components such as a CR motor 408, an LF motor 409, the print head 1, and the restoring unit 5 (the wiper 6, the cap 7, and the suction mechanism 413) based on the operation conditions via driving circuits 404 to 407. A driving circuit 414 is driven in response to a signal from the sensor 4, thereby operating the cleaning web 3. The CR motor 408 is a motor that drives the carriage 2 and the LF motor 409 is a motor that drives an LF roller that conveys a print medium.

Wiping Operation of Cleaning Web

Some inks solidify after adhering to the head surface and thus cannot be completely removed by being wiped by the wiper 6. Examples of such inks include an ink containing a volatile low-boiling solvent (including low-molecular weight alcohols such as IPA, ketones such as MEK, and esters such as ethyl acetate) and an ink containing a large amount of polymers to disperse pigment. An ink that is more likely to become concentrated due to the pigment in the ink negligibly dispersing has the same problem. The original viscosity of such an ink does not differ to a large extent from that of other inks, so that the ink can be wiped away without any problem in many cases. However, after the ink undergoes evaporation, the viscosity of the ink is more likely to increase than that of the other inks and thus the ink becomes more difficult to remove than typical inks.

Inks that become effective as a result of a change caused by evaporation are extremely difficult to wipe away compared to the above-described ink whose viscosity simply increases as a result of evaporation. Examples of such inks include an ink that changes its phase as a result of undergoing evaporation or heating and an ink that causes dispersion breakdown or solidifies as a result of an increase in density due to evaporation.

As shown in the above, when it is difficult for the wiper to restore the orifice face of the head, the orifice face is cleaned (wiped) by using a sheet-form member 9 (wiping member). Specifically, the orifice face of the print head 1 is cleaned (wiped) by the cleaning web 3 illustrated in FIG. 5. The cleaning web 3 includes a sheet-form member 9 that extends in one direction, a pressing member 10 that presses the sheet-form member 9 against the orifice face, and a winding device 8 that winds the sheet-form member 9. The sheet-form member 9 is wound around the winding device 8 including a winding roller and a transporting roller. Preferably, the sheet-form member 9 is made of a material such as a nonwoven fabric made of polyolefin, PET, or nylon. Preferably, the sheet-form member 9 is wetted in advance by being impregnated with an impregnant liquid in order to improve its wiping ability. Preferably, the impregnant liquid is a liquid with which a solidified ink can be wiped away, such as a liquid containing water, surfactant, and solvent. The pressing member 10 includes a metal-made base 10*a* and a rubber-made protrusion 10*b*. The height of the pressing member 10 is adjusted so that the rubber-made protrusion 10*b* raises a portion of the sheet-form member 9. The raised portion of the sheet-form member 9 is pressed against a portion of the orifice face of the print head 1 that is positioned directly above the raised portion of the sheet-form member 9. A force with which the pressing member 10 is pressed against the orifice face (or the pressure for wiping) can be adjusted by changing the height of the pressing member 10.

Figure 5:
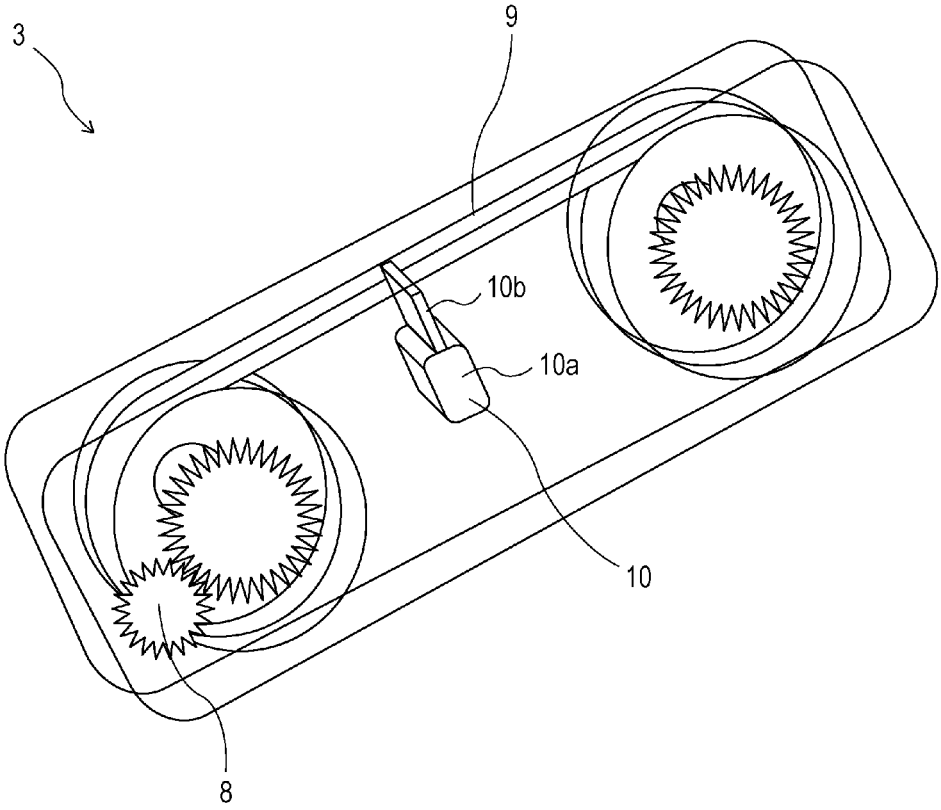
FIG. 5 is a schematic view of a cleaning web.
Figure 6:
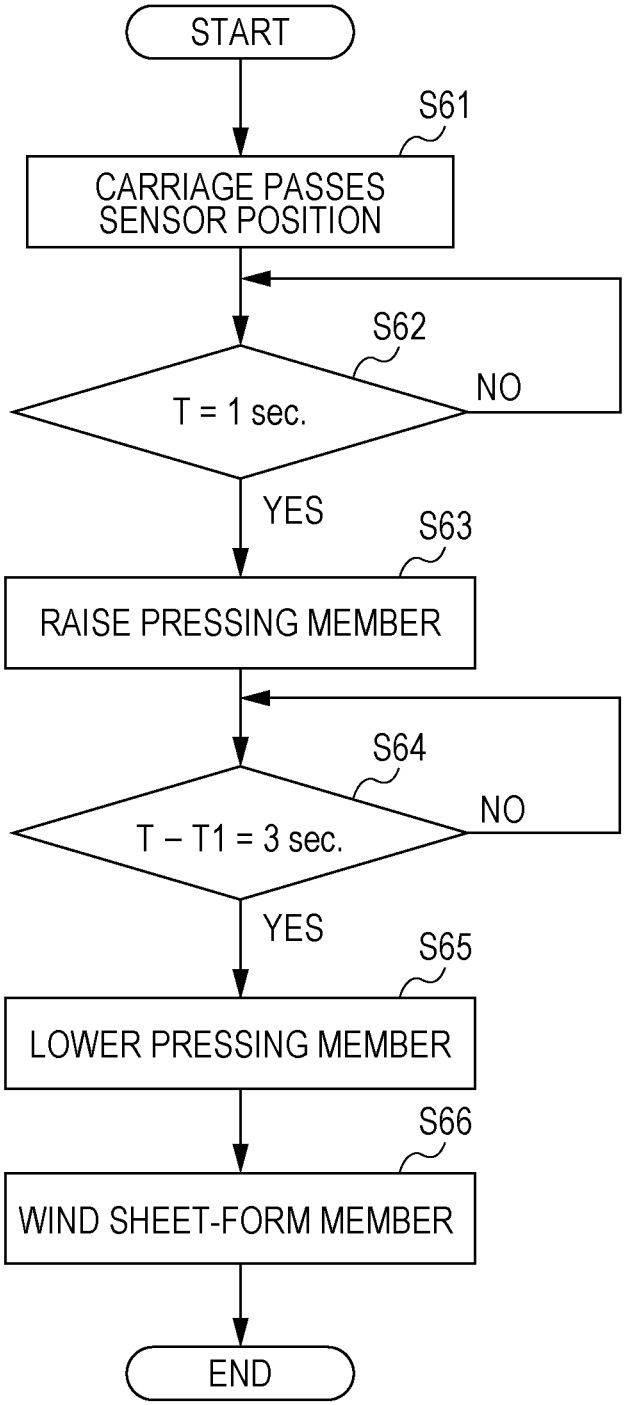
FIG. 6 is a flowchart of an operation of the cleaning web.
Figure 7:
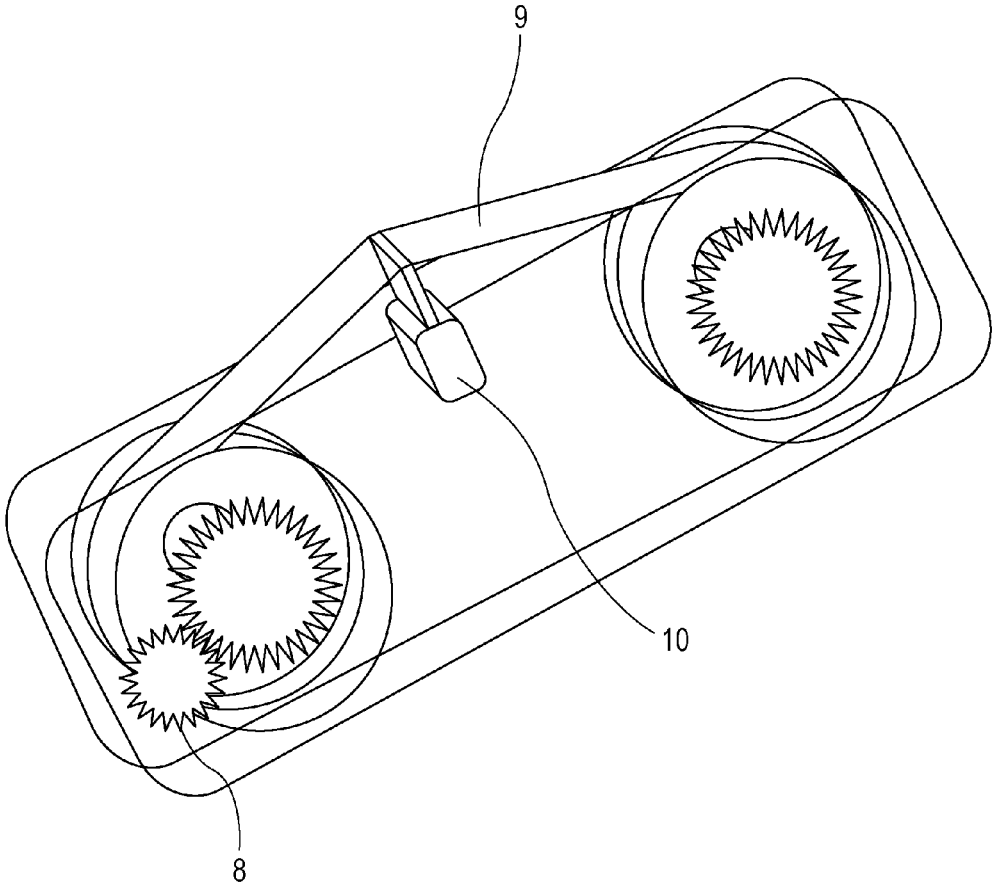
FIG. 7 is a schematic view of the cleaning web in a state in which a pressing member of the cleaning web is raised.

FIG. 6 illustrates an example of a sequence during a wiping operation. As illustrated in FIG. 5, originally, the pressing member 10 is not in contact with the sheet-form member 9 and the sheet-form member 9 is stretched straight between the winding roller and the transporting roller. After the carriage 2 on which the print head 1 is mounted passes the sensor 4 (step S61), whether or not one second has passed from when the carriage 2 passed the sensor 4 is determined, for example (step S62). When one second has passed since the carriage 2 passed the sensor 4, the pressing member 10 is raised to a level at which the sheet-form member 9 comes into contact with the orifice face of the print head 1 (step S63), so that the sheet-form member 9 is raised by the pressing member 10 (also see FIG. 7).

Subsequently, whether or not three seconds have passed since the pressing member 10 was raised is determined (step S64). When three seconds have passed, the pressing member 10 is lowered (step S65) and returned to the state illustrated in FIG. 5. In other words, while the sheet-form member 9 is raised as a result of the pressing member 10 being raised, the carriage 2 passes over the sheet-form member 9. Accordingly, the orifice face of the print head 1 is wiped by the sheet-form member 9 and the ink adhering to the orifice face is absorbed by the sheet-form member 9 so that the orifice face is cleaned.

The timing at which the pressing member 10 is lowered is not limited to three seconds after the pressing member 10 is raised and may be determined appropriately as long as the orifice face of the print head can be wiped by the sheet-form member 9 at the timing. Operations of raising and lowering the pressing member 10 are repeated for each scanning movement of the carriage 2. The winding device 8 can wind the sheet-form member 9 by causing a motor to rotate a gear wheel. After the pressing member 10 is lowered, the winding device 8 winds the sheet-form member 9 for the subsequent wiping operation in a direction in which the carriage 2 moves toward the cleaning web 3 (Step S66). Since the sheet-form member 9 is wound in this manner, the orifice face of the print head 1 can be cleaned with an unused portion of the sheet-form member 9 in the subsequent wiping operation.

Figure 8:
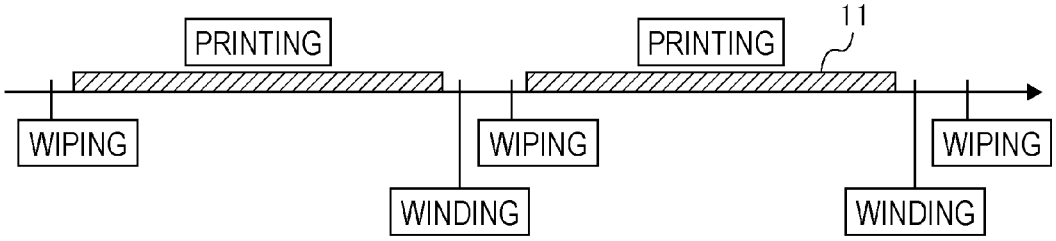
FIG. 8 is a schematic view of a wiping operation sequence according to a first embodiment.

Now, the state of the sheet-form member 9 after the wiping operation will be described. Here, as an example, the case is described where an operation of winding the sheet-form member 9 is performed immediately before a wiping operation in which the orifice face of the print head 1 is cleaned. To clean the orifice face using the sheet-form member 9, a wiping operation and a winding operation are alternately performed (also see FIG. 8). The shaded portions 11 illustrated in FIG. 8 indicate the periods in which the printing operation is performed.

Figure 9A:
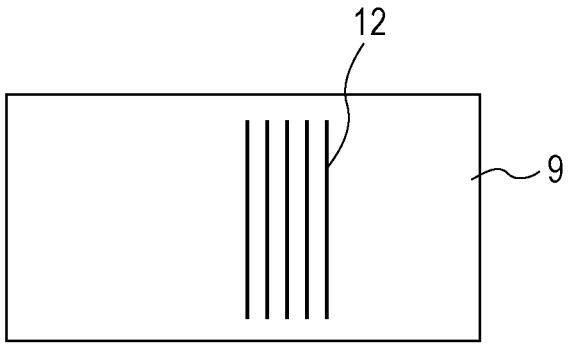
FIGS. 9A and 9B are schematic views of wiper tracks formed during the wiping operation according to the first embodiment.
Figure 9B:
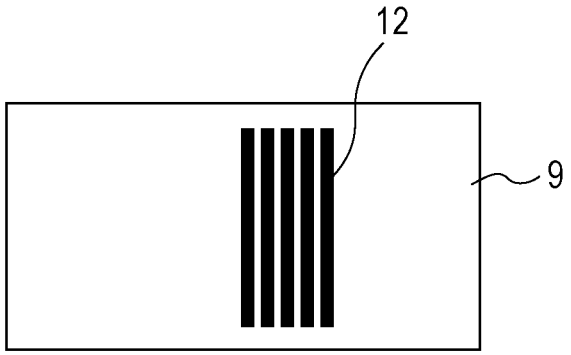

When the orifice face of the print head 1 stained with an ink is wiped by the sheet-form member 9, the ink adheres to the sheet-form member 9 and a wiper track 12 is formed on the sheet-form member 9 (see FIG. 9A). If the ink is left on the orifice face without being wiped away, the ink spreads over the orifice face with time. Consequently, as the time passes, a wider wiper track 12 is formed on the sheet-form member 9 in the wiping operation (see FIG. 9B). In view of the above circumstances, in order for the orifice face to be sufficiently cleaned in the subsequent wiping operation, the length of the sheet-form member 9 that is to be wound should be controlled such that an unused area is prepared for the subsequent wiping operation even when a wide wiper track 12 has been formed on the sheet-form member 9 due to the ink spreading over the orifice face. In other words, it is required that a portion of the sheet-form member 9 that is to be used for the subsequent wiping operation should be an unused portion, a portion to which an ink has not adhered, even when the ink has spread over the orifice face. Consequently, the subsequent wiping operation can be performed using an unused portion of the sheet-form member 9 (also see FIGS. 10A to 10D).

Figures 10A, 10B, 10C, 10D:
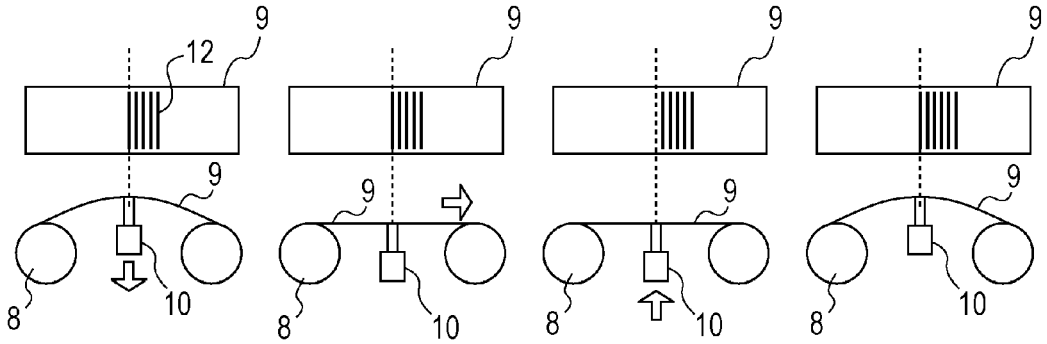
FIGS. 10A to 10D are schematic views of the wiping operation according to the first embodiment.

Specifically, after a first wiping operation (first cleaning step) is performed using the sheet-form member 9 as illustrated in FIG. 10A, the pressing member 10 is lowered as illustrated in FIG. 10B. Consequently, a wiper track 12 is formed in a portion of the sheet-form member 9 that has come into contact with the print head 1. Subsequently, as illustrated in FIG. 10C, a winding operation (winding step) of the sheet-form member 9 is performed such that an unused portion of the sheet-form member 9 is positioned immediately above the pressing member 10 in a second wiping operation considering the amount of ink that has spread over. Subsequently, when the second wiping operation (second cleaning step) is performed in this state as illustrated in FIG. 10D, the ink adheres to the sheet-form member 9 and thus another wiper track 12 is formed in the second wiping operation at a position on the sheet-form member 9 that does not overlap the wiper track 12 formed in the first wiping operation. In other words, when the sheet-form member 9 is wound before the second wiping operation, the sheet-form member 9 is wound considering the amount of ink that has spread over, thereby high reliably performing a restoring operation.

As the length of time between the first wiping operation and the second wiping operation increases, the width of the wiper track 12 increases. Since the winding operation is performed immediately before the second wiping operation, the amount of ink that has spread over at the time of the second wiping operation can be considered as being the same as that at the time of the winding operation. In view of these facts, the length of the sheet-form member 9 that is to be wound is controlled such that a larger length of the sheet-form member 9 is wound as the length of time between the first wiping operation and the second wiping operation increases based on measurement of the length of time between the first wiping operation and the second wiping operation using a timer. This control can be performed by the control unit mounted on the main body 402.

Figure 11:
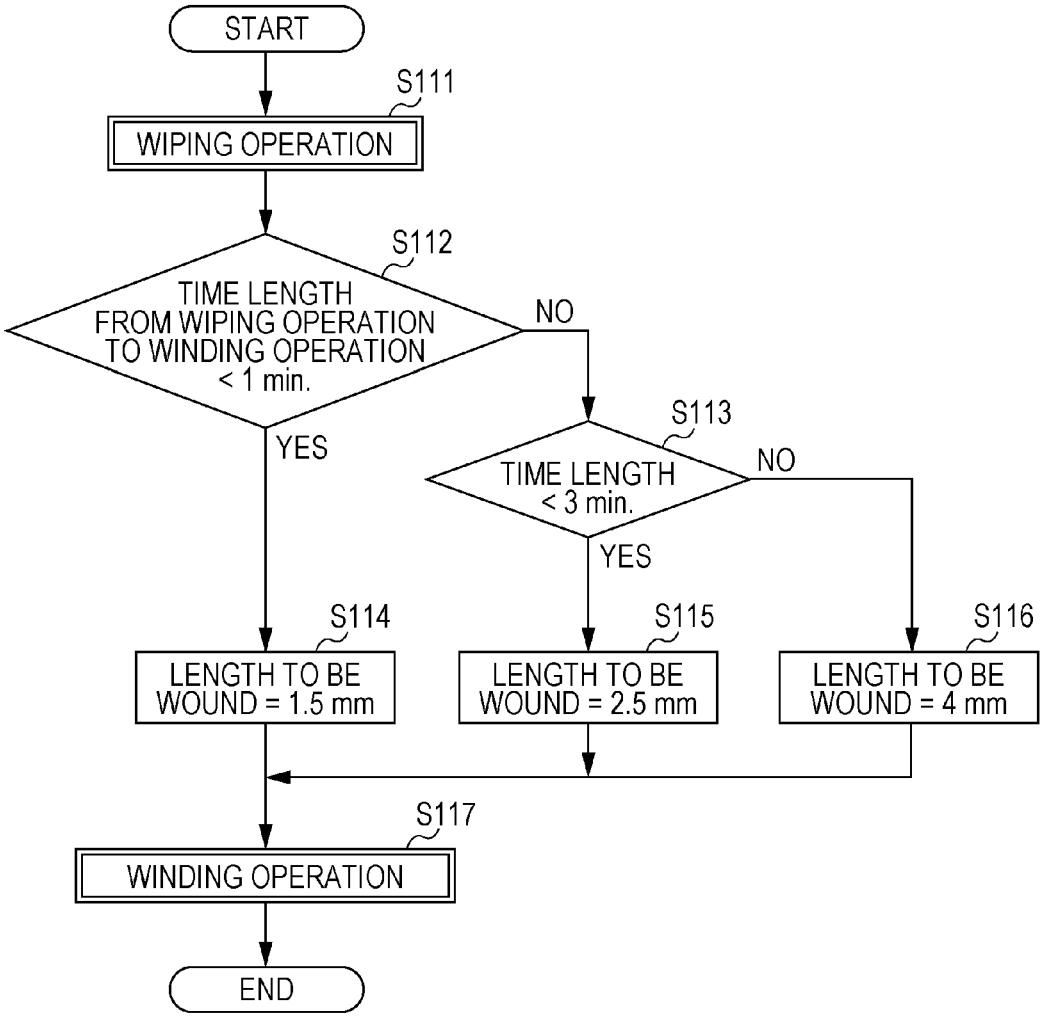
FIG. 11 is a flowchart of a cleaning procedure from the wiping operation to a winding operation according to the first embodiment.

FIG. 11 is a flowchart of a method of controlling cleaning of the print head of the printing apparatus according to the embodiment. In the embodiment, the length of the sheet-form member 9 that is to be wound is changed (steps S112 and S113) in accordance with the length of time between the first wiping operation (step S111) and the winding operation (step S117). For example, when the length of time between the first wiping operation and the winding operation is less than one minute, the length of the sheet-form member 9 that is to be wound is set to 1.5 mm (step S114), whereas when the length of time between the first wiping operation and the winding operation is not less than one minute but not more than three minutes, the length of the sheet-form member 9 that is to be wound is set to 2.5 mm (step S115). When the length of time between the first wiping operation and the winding operation is not less than three minutes, the length of the sheet-form member 9 that is to be wound is set to 4 mm (step S116). In this manner, only two thresholds are set in the timer in the embodiment. However, three or more thresholds may be set. In addition, specific values for the length of the sheet-form member 9 that is to be wound may be appropriately determined considering the amount of ink that has spread over that corresponds to the length of time between the first wiping operation and the winding operation.

FIG. 12 illustrates a table for comparing the following cases: the case where, as in the embodiment, the length of the sheet-form member 9 that is to be wound is controlled considering the length of time between the first wiping operation and the winding operation, that is, the length of time between the first wiping operation and the second wiping operation; and the case where the length of the sheet-form member 9 that is to be wound remains constant at 2 mm. The table shows the lengths of the sheet-form member 9 used to print an image of an A1 size with four passes and eight passes. According to the embodiment, the length of use of the sheet-form member is reduced as a whole by performing controlling such that the length of the sheet-form member 9 that is to be wound after a wiping operation increases as the length of time between the first wiping operation and the second wiping operation increases, considering the amount of ink that has spread over. In other words, the waste of the sheet-form member is reduced by changing the length of the sheet-form member 9 that is to be wound considering the amount of ink that has spread over.

Second Embodiment

Figure 13:
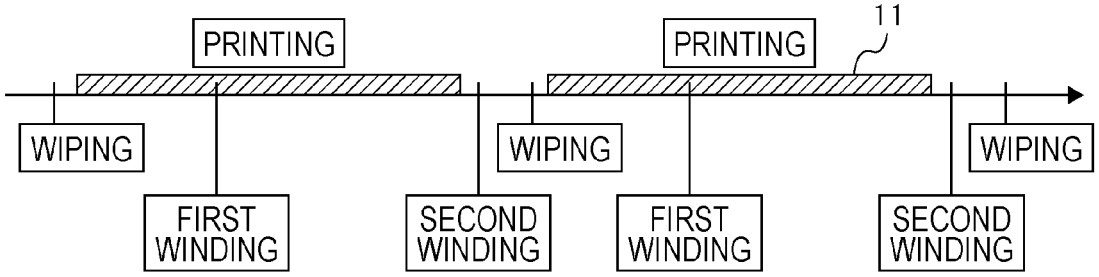
FIG. 13 is a schematic view of a cleaning sequence according to a second embodiment.

Referring now to the flowchart of FIG. 14, a method of controlling a printing apparatus to clean a print head according to a second embodiment will be described. In this embodiment, after a first wiping operation of the orifice face of the print head 1 is performed (step S131), a first winding operation is performed (step S132). Then, a second winding operation is performed (step S138) immediately before a second wiping operation. In this flowchart, the first wiping operation is followed by the first winding operation and the second winding operation. Then, the subsequent wiping operation (cleaning operation) is performed using an unused portion of the sheet-form member (also see FIG. 13). The shaded portions 11 illustrated in FIG. 13 indicate the periods in which the printing operation is performed.

As in the case of the first embodiment, the width of the wiper track formed on the sheet-form member 9 by the ink adhering to the sheet-form member 9 increases as the ink is left on the orifice face for a longer time. In this embodiment, after a predetermined length of time passes from the first wiping operation (step S131), the first winding operation is performed (step S132) in which a predetermined length of sheet-form member 9 is wound without considering the amount of ink that has spread over. Thereafter, a second winding operation is performed (step S138) immediately before a second wiping operation such that an unused portion of the sheet-form member is prepared for the second wiping operation considering the amount of ink that has spread over. By dividing the winding operation into two steps in this manner, the time taken for the second winding operation can be reduced, thereby improving the throughput.

As in the case of the first embodiment, the sum of the lengths of the sheet-form member 9 that are to be wound in the first and second winding operations should be determined considering the amount of ink that spreads during the time between the first wiping operation and the second wiping operation. Specifically, the width of the wiper track 12 increases as the length of time between the first wiping operation and the second wiping operation increases. Thus, the sum of the lengths of the sheet-form member 9 that are to be wound in the first and second winding operations should increase as the length of time between the first wiping operation and the second wiping operation increases.

In this embodiment, only a predetermined length of sheet-form member 9 is wound in the first winding operation. Thus, only the length obtained by subtracting a predetermined length from the sum of lengths has to be wound in the second winding operation. In other words, the amount of ink that has spread over is taken into consideration to wind the sheet-form member 9 in the second winding operation (step S138).

Now, a method of calculating the length of the sheet-form member 9 that is to be wound is specifically described.

As described above, the first winding operation is performed a predetermined time after the first wiping operation. In addition, since the second winding operation is performed immediately before the second wiping operation, the amount of ink that spreads at the time of the second wiping operation can be considered as being the same as that at the time of the second winding operation. Thus, by measuring the length of time between the first winding operation and the second winding operation using a timer, the length of time between the first wiping operation and the second wiping operation can be estimated.

Thereafter, the second wiping operation can be performed using a portion of the sheet-form member 9 that does not overlap the wiper track 12 formed in the first wiping operation by performing controlling such that the length of the sheet-form member 9 that is to be wound in the second winding operation increases as the length of time between the first winding operation and the second winding operation increases considering the amount of ink that has spread over. This control can be performed by the control unit mounted on the main body 402. FIG. 14 is a flowchart of the cleaning procedure from the first wiping operation to the second winding operation according to the embodiment.

In this embodiment, after the first wiping operation (step S131) is performed, the first winding operation (step S132) is performed. Subsequently, the length of the sheet-form member 9 that is to be wound in the second winding operation is changed in accordance with the length of time between the first winding operation and the second winding operation (steps S133 and S134). For example, when the length of time between the first winding operation and the second winding operation is less than thirty seconds, the length of the sheet-form member 9 that is to be wound in the second winding operation is set to 0.5 mm (step S135), whereas when the length of time between the first winding operation and the second winding operation is not less than thirty seconds but not more than one minute, the length of the sheet-form member 9 that is to be wound is set to 1 mm (step S136). When the length of time between the first winding operation and the second winding operation is not less than one minute, the length of the sheet-form member 9 that is to be wound in the second winding operation is set to 2 mm (step S137). In this embodiment, the length of the sheet-form member 9 that is to be wound in the first winding operation is fixed. In this embodiment, the length of the sheet-form member 9 that is to be wound in the second winding operation is determined from among three levels depending on the length of time measured by a timer, but may be determined from among two levels or four or more levels. A threshold of the length of time between the first winding operation and the second winding operation and a specific value of the length of the sheet-form member 9 that is to be wound may be appropriately determined according to the amount of ink that has spread over. Immediately after the second winding operation is performed (step S138), the second wiping operation is performed in which the orifice face of the print head is cleaned by the sheet-form member 9.

FIG. 15 is a table in which the length of the sheet-form member that is used in the case where the cleaning sequence according to the embodiment is performed is compared with that of the case where 2 mm of the sheet-form member is wound in each winding operation. Here, the table shows the lengths of the sheet-form member 9 that are used to print an image of an A1 size with four passes and eight passes. According to the embodiment, the length of use of the sheet-form member is reduced as a whole by performing controlling such that the length of the sheet-form member 9 that is to be wound in the second winding operation increases as the length of time between the first winding operation and the second winding operation increases. In other words, the waste of the sheet-form member is reduced by changing the length of the sheet-form member 9 that is to be wound considering the amount of ink that has spread over.

Third Embodiment

A third embodiment describes the case where a printing apparatus is controlled by estimating the length of the sheet-form member 9 that is to be wound in the winding operation following the wiping operation based on an image to be printed or printing conditions. In the first embodiment and the second embodiment, the length of the sheet-form member that is to be wound is controlled based on the length of time between the wiping operation and the winding operation or between the first wiping operation and the second wiping operation. The length of time between the operations is determined by the speed at which the carriage travels and the width of an image to be printed (to-be-printed image). Accordingly, if the width of the to-be-printed image in the main scan direction or printing conditions are found, the length of the sheet-form member 9 that is to be wound can be appropriately determined in advance without having to measure the length of time between the operations using a timer. For example, the control unit estimates the length of time between operations based on the distance over which the carriage travels during one reciprocal movement and the speed at which the carriage travels. Then, the control unit determines the length of the sheet-form member 9 that is to be wound based on the length of time between the operations.

For example, a case is considered where an image of the A0 size is printed by bidirectional printing while the carriage travels at the speed of 33.3 ips (inches/second), the carriage travels at the speed of 40.0 ips while not in printing operation, and the width of the to-be-printed image is 54 inches. In this case, the time taken for the carriage to make one reciprocal movement is approximately 2.7 seconds. Thus, by referring to the flowchart of FIG. 11, the length of the sheet-form member 9 that is to be wound can be determined at 2.5 mm.

Figure 16:
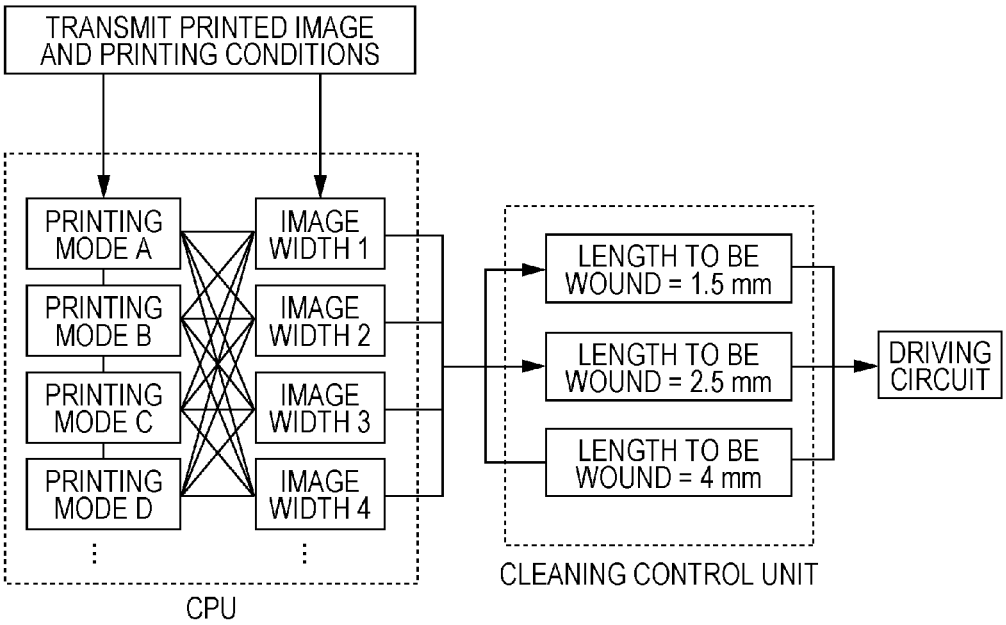
FIG. 16 is a block diagram of a winding control according to a third embodiment.

In this manner, by data and printing conditions of a to-be-printed image being transmitted from the input device 403 to the printing apparatus main body 402, the control unit automatically calculates the length of the sheet-form member 9 that is to be wound and thus determines an optimal length of the sheet-form member 9 that is to be wound. FIG. 16 is a block diagram of a winding control according to the embodiment. As in the case of the embodiment, by estimating the length of the sheet-form member 9 that is to be wound based on the to-be-printed image and printing conditions, a winding operation can be performed during a printing operation without having to divide the winding operation into two steps as in the case of the second embodiment. Consequently, the throughput can be prevented from being reduced due to the winding operation.

Figure 14:
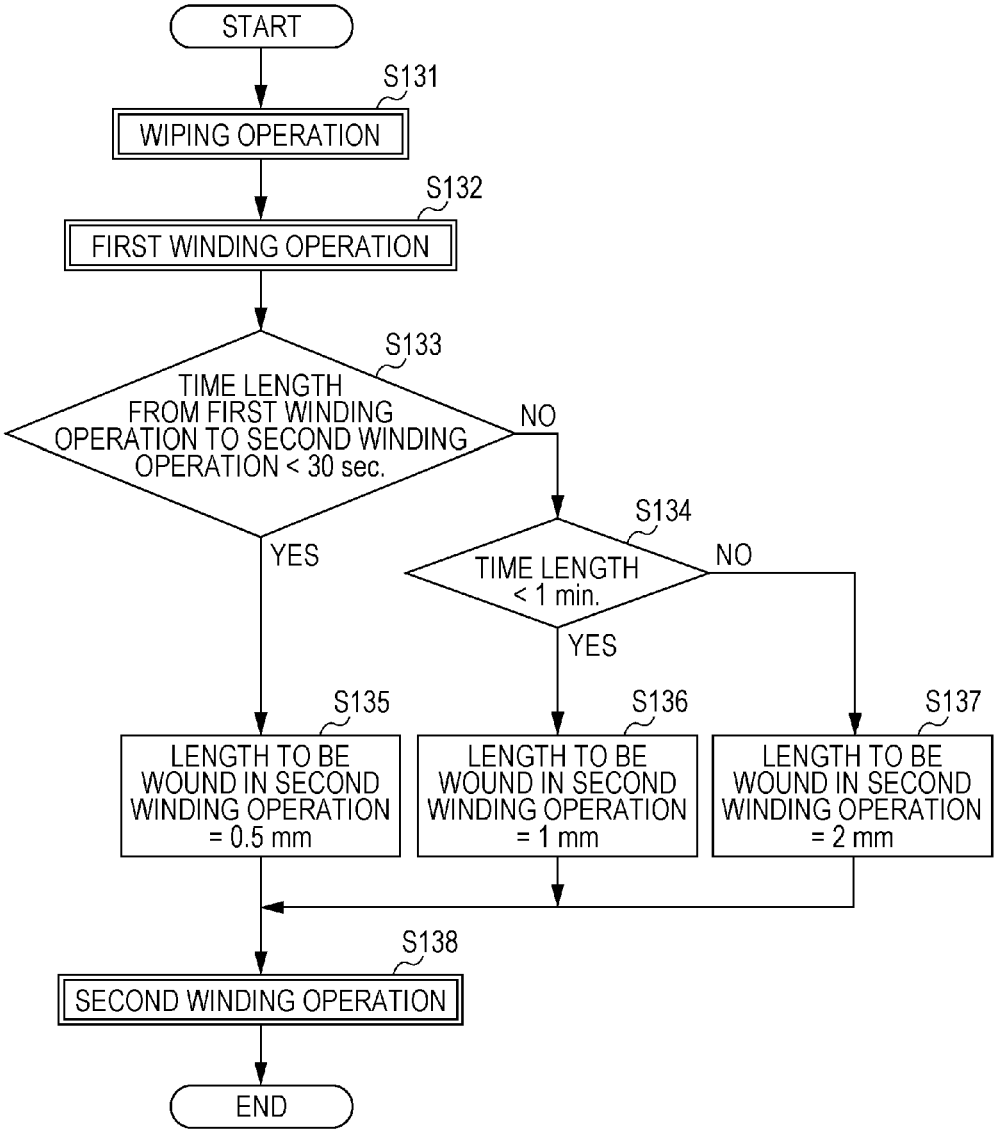
FIG. 14 is a flowchart of a cleaning procedure from a wiping operation to a winding operation according to the second embodiment.

A program that causes a printing apparatus to execute the flowcharts illustrated in FIGS. 6, 11, and 14 or a storage medium that stores this program are also included in the scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-073136 filed Mar. 28, 2012 and Japanese Patent Application No. 2013-011886 filed Jan. 25, 2013, which are hereby incorporated by reference herein in their entirety.

What is claimed is:

1. A printing apparatus comprising:

a print head having an orifice face, wherein the orifice face includes an ejection orifice configured to eject a liquid;

a scanning unit configured to perform scanning while reciprocating the print head;

a sheet-form member configured to perform a wiping operation of the orifice face of the print head, wherein the wiping operation includes a first wiping operation and a second wiping operation;

a winding device configured to perform a winding operation of the sheet-form member; and a determining unit configured to determine a length of the sheet-form member that is to be wound by the winding device in accordance with a length of time between the first wiping operation performed by the sheet-form member and the second wiping operation performed by the sheet-form member that follows the first wiping operation.

2. The printing apparatus according to claim 1, wherein the determining unit determines the length of the sheet-form member that is to be wound such that the length of the sheet-form member that is to be wound increases as the length of time between the first wiping operation and the second wiping operation increases.

3. The printing apparatus according to claim 1, wherein the wiping operation of the orifice face of the print head is performed by the sheet-form member as a result of the scanning unit performing scanning over the sheet-form member.

4. The printing apparatus according to claim 1, wherein the sheet-form member is impregnated with a liquid.

5. The printing apparatus according to claim 1, further comprising:

a pressing member configured to raise a portion of the sheet-form member while the wiping operation is performed to bring the sheet-form member into contact with the orifice face.

6. The printing apparatus according to claim 1, wherein the sheet-form member is positioned in an end portion of an area over which the scanning unit performs scanning.

7. The printing apparatus according to claim 1, wherein the winding device performs the winding operation immediately before the second wiping operation, and wherein the determining unit determines the length of the sheet-form member that is to be wound based on a length of time between the first wiping operation and the winding operation.

8. The printing apparatus according to claim 1, wherein the winding operation performed by the winding device is performed in two steps including a first winding operation and a second winding operation, wherein the first winding operation is performed a predetermined time after the first wiping operation, wherein the second winding operation is performed immediately before the second wiping operation, and wherein the determining unit determines the length of the sheet-form member that is to be wound based on a length of time between the first winding operation and the second winding operation.

9. The printing apparatus according to claim 1, wherein the determining unit determines the length of the sheet-form member that is to be wound based on a speed at which the scanning unit travels and a distance over which the scanning unit travels during one reciprocal movement.

10. A method for a printing apparatus, wherein the printing apparatus includes a print head having an orifice face and a sheet-form member configured to perform a wiping operation of the orifice face, wherein the orifice face includes an ejection orifice configured to eject a liquid, the method comprising:

performing scanning while reciprocating the print head;

performing a wiping operation of the orifice face of the print head, wherein the wiping operation includes a first wiping operation and a second wiping operation;

performing a winding operation of the sheet-form member; and determining a length of the sheet-form member that is to be wound by the winding device in accordance with a length of time between the first wiping operation performed by the sheet-form member and the second wiping operation performed by the sheet-form member that follows the first wiping operation.

* * * * *